US005565902A

United States Patent [19]

Nardone et al.

[11] Patent Number: 5,565,902

[45] Date of Patent: Oct. 15, 1996

[54] THREE-PASS THERMAL DYE TRANSFER COLOR PRINTER WITH CONTINUOUS WEB PRINT MEDIA

[75] Inventors: Edward A. Nardone, Wakefield; Harry D. Schofield, Narragansett, both of R.I.

[73] Assignee: Atlantek, Inc., Wakefield, R.I.

[21] Appl. No.: 224,166

[22] Filed: Apr. 7, 1994

[51] Int. Cl.[6] ..... B41J 2/32

[52] U.S. Cl. ..... 347/171

[58] Field of Search ..... 346/24, 134, 16, 346/136; 400/611, 583, 617, 706, 707; 347/197, 172, 176, 174

[56] References Cited

U.S. PATENT DOCUMENTS

| | | | |
|---|---|---|---|
| 4,438,320 | 3/1984 | Woodard et al. | 347/205 |
| 5,021,804 | 6/1991 | Nozawa et al. | 347/176 |
| 5,218,380 | 6/1993 | Fiscella | 346/136 |
| 5,270,735 | 12/1993 | Fiscella et al. | 347/172 |

*Primary Examiner*—Huan H. Tran
*Assistant Examiner*—L. Anderson
*Attorney, Agent, or Firm*—Salter & Michaelson

[57] ABSTRACT

A three-pass thermal color printer for printing a color image on a continuous web of thermal print media consists of a thermal printhead having an upstream side adjacent the roll of print media and an opposite downstream side. The printer further consists of an associated printhead platen, and a set of drive rollers positioned between the printhead and the roll of print media. The drive rollers are operative for drawing the print media through the printhead in an upstream direction, i.e. toward the roll of print media, and advancing the print media in a downstream direction. In operation, the drive rollers draw the print media in an upstream direction whereby the printhead prints an image on the print media starting from a mid-point on the print media to the terminal end thereof. The drive rollers then advance the print media in a downstream direction so that the next printing operation can be overlayed onto the first printed image. The printer reciprocates the print media back and forth until three separate color images are overlayed to achieve a full-color image. The drive rollers are further operative for advancing the print media in a downstream direction to eject the printed image form the printer. The instant printing arrangement has no wasted print media when the printed image is severed from the continuous web.

4 Claims, 1 Drawing Sheet

THREE-PASS THERMAL DYE TRANSFER COLOR PRINTER WITH CONTINUOUS WEB PRINT MEDIA

BACKGROUND AND SUMMARY OF THE INVENTION

The instant invention relates to thermal color printers and more particularly to a three-pass thermal dye transfer color printer with a continuous web print media.

Three-pass thermal color printers utilizing a continuous web of print media have heretofore been known in the art. In this regard, the U.S. Pat. No. to Nozawa et al U.S. Pat. No. 5,021,804; Fiscella et al U.S. Pat. No. 5,270,735; and Fiscella U.S. Pat. No. 5,218,380 represent the closest prior art to the subject invention of which the Applicant is aware.

The basic printing arrangement as taught by the prior art is illustrated in simplified form in prior art FIG. 1. A three-pass thermal color printer prints three separate primary colors in overlapping relation onto a thermal print media 10 to achieve a single full color image. In this connection, a roll 12 of transfer film 14 is provided with sequential sets of colored panels, i.e. Yellow, Magenta, Cyan, Yellow, Magenta, Cyan, etc. In each of the prior art printing device cited above, the primary drive rollers 16 are situated downstream of the printhead 18, i.e. the printhead 18 is situated between the roll of print media 10 and the drive rollers 16 so that the print media 10 is drawn through the printhead 18 from the continuous web. In most cases a cutter mechanism 20 is provided at the outlet of the printing device for separating the printed section of the print media from the continuous web. In operation of the prior art printing devices, the drive rollers 16 draw the print media 10 through the printhead 18 in the direction of arrow 22 to print the first color. The printhead 18 is then lifted and the drive rollers 16 reverse to push the print media 10 backwardly in the direction of arrow 24 to its starting position in preparation for printing the next color in overlapping relation. The printhead 18 is lowered, the dye ribbon 14 advanced to the next color panel, and then the drive rollers 16 again draw the print media 10 through the printhead 18 to print the second color. The process is repeated for the third color to achieve a full color print. The print media 10 is then advanced outwardly of the printer and severed by the cutter mechanism 20 at cut line 26.

While the prior art printing devices are effective for producing high-quality color images, it has been found that there is a significant amount of print media 10 wasted for each image that is printed and separately removed from the printer, i.e. when the printer is used for single image, or one-up instant issue printing. When the prior art printers are used in single image printing, they effectively waste a length of print media equal to the distance between the print line 28 of the printhead 18 to the cutter mechanism 20 each time an image is printed. In reality, this can translate into several inches of wasted print media for each printed image removed from the printer.

The instant invention provides a three-pass thermal dye transfer color printer for printing a color image on a continuous web of print media which overcomes the media waste problems of the prior art printers. The instant thermal printer comprises a thermal print station comprising a thermal printhead and an associated printhead platen. The printhead has an upstream side positioned adjacent the roll of print media and an opposite downstream side. The thermal printer further comprises a set of drive rollers positioned between the printhead and the roll of print media. The drive rollers are operative for drawing the print media through the printhead in an upstream direction, i.e. toward the roll of print media, and advancing the print media in a downstream direction. In operation, the drive rollers draw the print media in an upstream direction whereby the printhead prints an image on the print media starting from a mid-point on the print media to the terminal end thereof. The drive rollers then advance the print media in a downstream direction so that the next printing operation can be overlayed onto the first printed image. The printer reciprocates the print media back and forth until three separate color images are overlayed to achieve a full color image. The drive rollers are further operative for advancing the print media in a downstream direction to eject the printed image form the printer. By reversing the orientation of the printhead and reversing the direction of printing, the instant printer effectively eliminates all wasted print media when the printed image is severed from the continuous web.

Accordingly, it is an object of the instant invention to provide a three-pass thermal dye transfer color printer with a continuous web of print media which does not waste print media.

It is another object to provide a three-pass thermal color printer which has a reversed direction of print.

It is still another object to provide a three-pass thermal color printer which is simple is design, easy to assemble, and inexpensive to manufacture.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
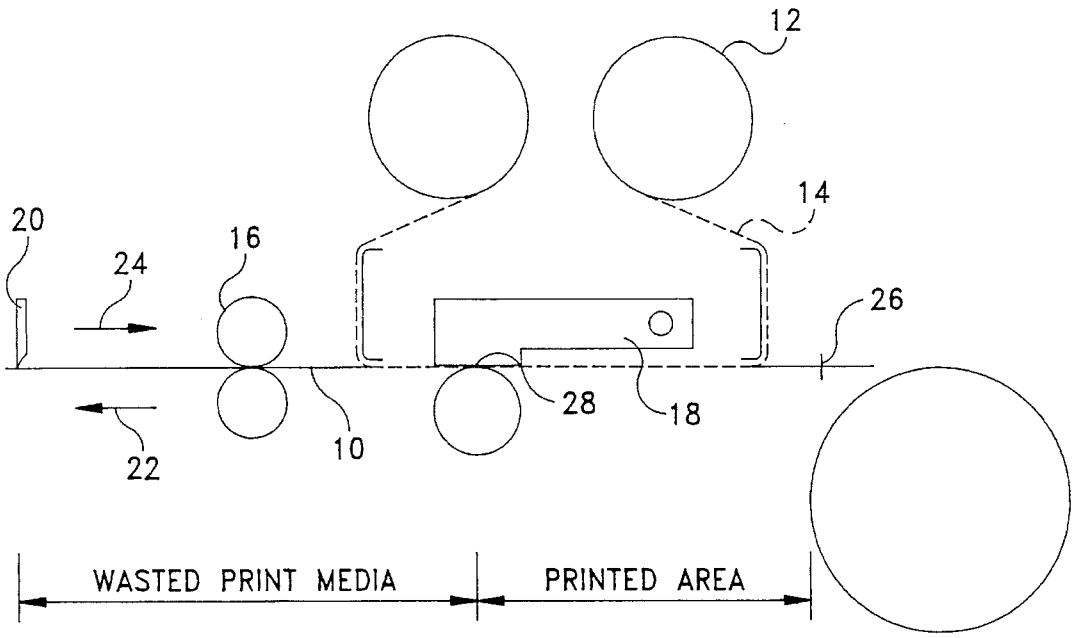
FIG. 1 (PRIOR ART)
FIG. 1 is a schematic view of the prior art printing arrangement.
Figure 2:
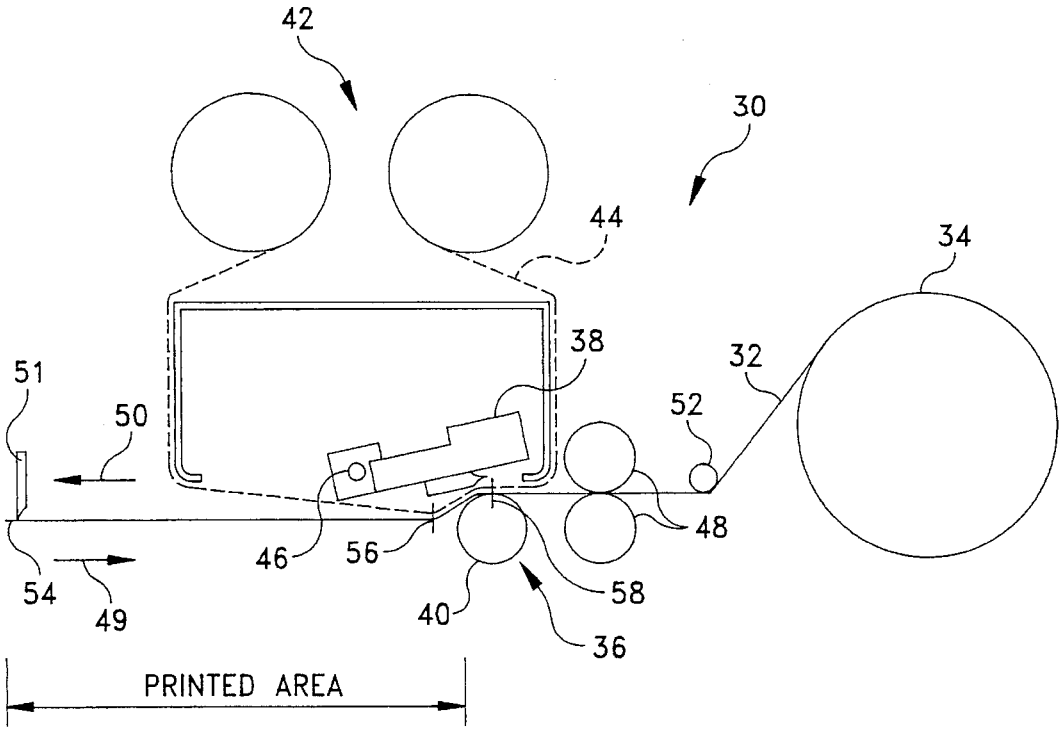
FIG. 2 is a schematic view of the printing device of the instant invention.

Referring now to drawing FIG. 2, the three-pass thermal dye transfer color printer of the instant invention is illustrated and generally indicated at 30. As will hereinafter be more fully described, the instant thermal printer 30 is operative for printing a full-color image onto a continuous web of print media 32. The print media 32 is preferably supplied in a roll 34 which is mounted in a print cabinet in a conventional manner.

The instant thermal printer 30 comprises a thermal print station generally indicated at 36 comprising a thermal printhead 38 and an associated printhead platen 40. The printhead 38 has an upstream side positioned adjacent the roll 34 of print media 32 and an opposite downstream side. The printer further includes a transfer film roll assembly generally indicated at 42. The film roll assembly includes a thermal dye transfer film 44 having sequential panels of Yellow, Magenta and Cyan dye. The roll assembly 42 is mounted in a conventional manner such that the film 44 passes between the printhead 38 and the thermal print media 32. The printhead 38 is mounted on a pivot 46 so that it is pivotably movable between a first position (not shown) wherein the printhead 38 is in biased engagement with the printhead platen 40, and a second position (FIG. 2) wherein the printhead 38 is spaced from the printhead platen. A cam mechanism (not shown) is operative for moving the printhead 38 between the first and second positions.

The thermal printer 30 further comprises a pair of drive rollers 48 positioned between the printhead 38 and the roll 34 of print media 32. The drive rollers 48 are operative for drawing the print media 32 in an upstream printing direction (arrow 49) when the printhead 38 is in the first position and for advancing the print media 32 in both the upstream direction (arrow 49) and the downstream direction (arrow 50) when the printhead 38 is in the second position. A cutting mechanism 51 is positioned downstream of the printhead 38 for severing the printed image from the print media 32. A guide roller 52 is positioned between the drive rollers 48 and the roll 32 to guide the print media 32 from the roll 34. The print media 32 is threaded through the print arrangement as illustrated in FIG. 2 so that a terminal end thereof 54 is positioned downstream of the printhead 38 adjacent to the cutter 51.

In operation, the printhead 38 is moved to the second (up) position (FIG. 2), and the drive rollers 48 initially advance the print media 32 in an upstream direction (arrow 49) so that the length of print media 32 downstream of the printhead 38 is equal to the length of the printed image. In this connection, the print media 32 is advanced upstream until point 56 is aligned with printline 58. The printhead 38 is then moved to the first (down) position and the print media 32 is drawn through the printhead 38 in an upstream direction, i.e. toward the media roll 34 (arrow 49), whereby the printhead 38 thermally prints an image on the print media 32 starting from mid-point 56 on the print media 32 to the terminal end 54. The printhead 38 is thereafter pivoted to the up position and the drive rollers 48 then advance the print media 32 in a downstream direction (arrow 50) so that the next printing operation can be overlayed onto the first printed image. The printer 30 repeats the printing procedure until three separate color images are overlayed to achieve a full-color image.

After the three printing operations are completed, the drive rollers 48 advance the print media 32 in a downstream direction (arrow 50) until mid-point 56 is positioned underneath the cutter 51 for severing the printed area from the roll of print media 32. In this regard, mid-point 56 also comprises the cut line for severance from the roll.

It can therefore be seen that the instant invention provides a novel three-pass thermal dye transfer printer which overcomes the disadvantages of the prior art. By reversing the orientation of the printhead and reversing the direction of printing, the instant printer effectively eliminates all wasted print media when the printed image is severed from the continuous web, and allows the media to be cut or cropped to the edge of the printed image. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A printing device for one-up instant issue printing of a single image on a continuous web of print media comprising:

a rotatable print head platen;

a print head mounted in cooperative association with said print head platen;

a continuous web of print media passing between said print head platen and said print head, said print head being operative for printing an image on said print media, said print head being mounted for movement between a first position wherein said print head is in engagement with said print head platen for printing on said print media, and a second position wherein said print head is spaced from said print head platen, said print head having an upstream side and a downstream side, said print media passing between said print head and said print head platen such that a terminal end of said print media is disposed adjacent said downstream side of the print head and a predetermined mid-point of print media is disposed adjacent said upstream side of said print head, said mid-point of said print media and said terminal end of said print media defining a print area in which an image is printed onto said print media; and a single reversible drive means for reversibly driving said continuous web of print media in upstream and downstream directions, said single reversible drive means being positioned on the upstream side of said print head such that said reversible drive means engages said print media at a point upstream of said mid-point, said reversible drive means being operative for drawing said continuous web of print media in an upstream direction when said print head is in said first position whereby an image is printed in said print area between said mid-point of said print media and said terminal end of said print media, said reversible drive means being further operable for advancing said print media in said downstream direction when said print head is in said second position; and cutting means for severing said print media at said mid-point such that said print area is severed from said continuous web of print media without waste of any unprinted area of said continuous web of print media.

2. A thermal printing device for one-up instant issue printing of a single image on a continuous web of thermal print media comprising:

a rotatable print head platen;

a thermal print head mounted in cooperative association with said print head platen;

a continuous web of thermal print media passing between said print head platen and said print head;

a continuous web of thermal color transfer film passing between said print media and said print head, said thermal print head being operable for transferring color from said film onto said print media to create an image on said print media, said print head being mounted for movement between a first position wherein said print head is in engagement with said print head platen for printing on said print media, and a second position wherein said print head is spaced from said print head platen, said print head having an upstream side and a downstream side, said print media passing between said print head and said print head platen such that a terminal end of said print media is disposed adjacent said downstream side of the print head and a predetermined mid-point of print media is disposed adjacent said upstream side of said print head, said mid-point of said print media and said terminal end of said print media defining a print area in which said single image is printed onto said print media; and a single reversible drive means for reversibly driving said continuous web of print media in upstream and downstream directions, said single reversible drive means being positioned on the upstream side of said print head such that said reversible drive means engages said print media at a point upstream of said mid-point, said reversible drive means being operative for drawing said continuous web of thermal print media in an upstream direction when said print head is in said first position whereby an image is thermally printed in said print area between said mid-point of said print media and said terminal end of said print media, said reversible drive means being further operable for advancing said print media in said downstream direction when said print head is in said second position; and cutting means for severing said print media at said mid-point such that said print area is severed from said continuous web of print media without waste of any unprinted area of said continuous web of thermal print media.

3. A method of one-up instant issue printing from a continuous web of print media comprising the steps of:

printing a single image onto a print area of a continuous web of print media, said print area being defined by a predetermined mid-point of said print media and a terminal end of said print media; and severing said continuous web of print media at said mid-point such that said print area is severed from said continuous web of print media without waste of any unprinted area of said continuous web of print media.

4. The method of claim 3 wherein said step of printing said single image comprises the step of thermally printing said image onto a thermal print media.

* * * * *